United States Patent [19]

Lindquist

[11] 3,984,913

[45] Oct. 12, 1976

[54] METHOD OF CONSTRUCTING AN ELECTRICAL FITTING THROUGH A PASSAGE IN A NON-CONDUCTIVE WALL

[75] Inventor: Nils Tommy Lindquist, Enskede, Sweden

[73] Assignee: Aktiebolaget Electrolux, Stockholm, Sweden

[22] Filed: Feb. 3, 1975

[21] Appl. No.: 546,303

[30] Foreign Application Priority Data

Feb. 7, 1974 Sweden ..... 7401618

[52] U.S. Cl. ..... 29/630 R; 174/152 R; 174/167; 339/218 R

[51] Int. Cl.[2] ..... H01R 9/00

[58] Field of Search ..... 29/630 R, 630 B, 630 C, 29/630 D, 629, 445, 416, 418, 423, 522; 174/167, 168, 166 R, 171, 169, 151, 154, 152; 339/218 R, 218 M; 264/249

[56] References Cited

UNITED STATES PATENTS

| | | | |
|---|---|---|---|
| 2,305,150 | 12/1942 | Fearon | 29/630 B UX |
| 2,505,979 | 5/1950 | Martin | 29/630 R X |
| 2,816,950 | 12/1957 | Kruss et al. | 174/151 X |
| 3,091,838 | 6/1963 | Hild et al. | 29/522 X |
| 3,758,916 | 9/1973 | Wetmore | 174/152 R X |

FOREIGN PATENTS OR APPLICATIONS

| | | |
|---|---|---|
| 1,297,207 | 5/1961 | France |
| 72,587 | 9/1947 | Norway |

*Primary Examiner*—C.W. Lanham
*Assistant Examiner*—James R. Duzan
*Attorney, Agent, or Firm*—Alfred Miller

[57] ABSTRACT

Method of passing an uninsulated, relatively rigid, conductor through an opening in a non-conductive housing wall. The conductor has a cross-section which is substantially less than the cross-section of the opening yet is firmly maintained in place by means of a rivet which presses a portion of the conductor against a surface surrounding the opening.

1 Claim, 2 Drawing Figures

METHOD OF CONSTRUCTING AN ELECTRICAL FITTING THROUGH A PASSAGE IN A NON-CONDUCTIVE WALL

BACKGROUND OF THE INVENTION

It is known to mass produce electrical appliances in which the motors, for example, are enclosed in a housing having a separating wall between the motor and the electrical supply. Previous structures utilized a method, after mounting of the motor, to pass wires from the motor through holes in the housing and out to a further connection to a current source. This effort is complex and time consuming since the wires have to be drawn through narrow spaces, and often by hand. Furthermore, in some cases it is necessary to have a sealed separating wall between the motor space and the ambient in order to prevent the heated cooling air emanating from the motor from coming into contact with heat sensitive parts of the appliance or device. Moreover, in certain devices, such as vacuum cleaners, it may be necessary to prevent the spaces therein, which are subject to negative pressure, to communicate with the motor space by the open passages through which the electric wires pass.

Another known construction is to use a fitting for electric wires in a hole present in a non-conductive separating wall. In this arrangement, a sleeve of electrically conductive material is passed through the hole and deformed at either side of the wall, after which the wires at either side of the wall are connected to the sleeve, for example, by soldering, and at their other ends provided with cable clips, or the like, in order to make further electrical connections. This arrangement is complicated and expensive.

The present invention relates to a method of making a passage fitting for an uninsulated conductor through an insulated wall which conducts electrical energy from one side thereof, having electrical parts, to the other side thereof.

SUMMARY OF THE INVENTION

It is an object of the present invention to provide a method of making an electrical passage fitting through an insulated wall which is inexpensive and easy to mount.

Another object of the present invention is to provide a firm connection between the electrical conductor and a surface of the through-hole which is maintained in position by means of a rivet, or the like.

An object of the present invention is to provide a method for making an electric passage fitting for electrical appliances having enclosed motors.

The invention will now be more fully described with reference to the accompanying drawings, in which:

FIG. 1 is a sectional view of an electrical conductor in a passage through a non-conductive wall and FIG. 2 is a sectional view similar to FIG. 1 with the conductor being fastened to the wall, and showing the conductor operatively connected to an electrical apparatus.

DESCRIPTION OF THE PREFERRED EMBODIMENT

Figure 1:
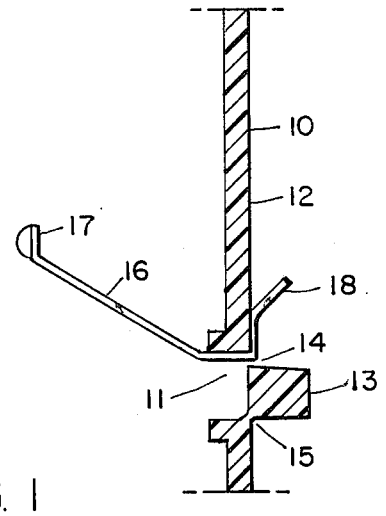

A wall 10 is shown which is non-conductive and is disposed between a space housing electrical parts, such as a motor, and another space of the electrical device. The wall being non-conductive is preferable constituted of a plastic, and is provided with a through hole 11 which on one side 12 of the wall has a member 13 integral thereof which forms a rivet. It will be noted that the diameter of the rivet 13 is slightly less than the diameter of the hole so that a narrow opening 14 is formed between an edge of the rivet periphery and the adjacent wall surface of the hole 11. A narrow bridge connection 15 initially connects the rivet 13 to the wall 10.

A metal plate or conductor 16 of the conductive material, which is non-insulated, is inserted through the narrow opening 14. One end 17 of the plate is provided with a hemispherical contact member 17, which is adapted to engage an electrical connection in a manner hereinafter described. The other end 18 of the metal plate 16 is bent at an angle of about 45° to side 12, and is formed as an attachment for a cable clip, or the like, which in turn connects the conductor to a source of electric current. The plate 16 is bent so as to at least partly adjoin the side 12 of the wall adjacent to the hole 11. At the other side of the wall 10, the plate or conductor 16 is bent at an angle to the longitudinal axis of the hole 11.

Figure 2:
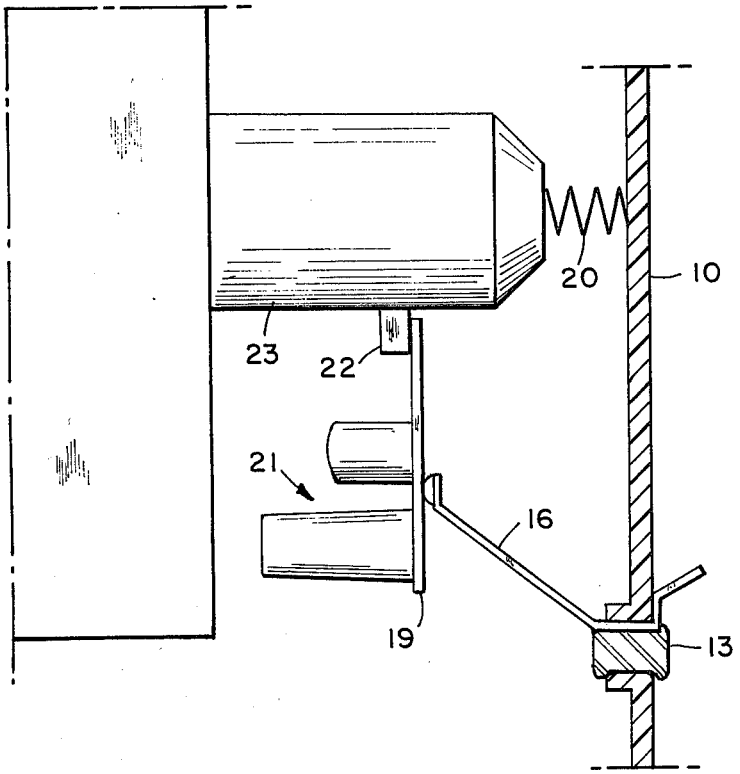

As seen in FIG. 2, when the plate 16 is inserted through the hole 11 the rivet 13 is severed at the bridge 15. The rivet is then placed in the hole 11 and upset at either side of the wall to thereby assume the form shown in FIG. 2. Thus, when the rivet 13 is upset, the plate 16 is clamped between a portion of the periphery of the rivet and the adjacent surface of the hole 11 resulting in a rigid electric fitting through the hole 11. Since the plate or conductor 16 is elongated and bent at an angle to the central axis of hole 11, the plate functions as a spring for positive contact with an electrical connection, for example, the copper-coated plate 19 associated with the electric motor 23. The housing for the motor includes the wall 10, and the motor is connected to the housing by means of a spring 20. Moreover, the plate 19, if mounted within a vacuum cleaner housing, can be in contact with an interference suppression device 21 and slip rings 22 of the electric motor.

The present method is particularly useful in mass production of electric devices and may be varied within the scope of the invention. For example, it is not necessary that the rivet be integral with the wall before the rivet is forced in the hole with the plate 16 in place. The rivet can also be in the form of a separate part and it can be of any suitable form, although a square, rectangular or circular form is preferrd. It should also be apparent that the present electrical fitting is not limited to use in devices of the above-described kind but may be utilized where any electrical connection through a wall is desired.

I claim:

1. A method of making an electrical fitting through a passage in a non-conductive wall comprising the steps of:

a. inserting an uninsulated electrical conductor through said passage, said conductor being of relatively rigid material and having one end on one side of said wall being adapted to electrically contact a conductive connecting means for an electrical apparatus, the end of said conductor on the other side of said wall having a mount for connection to a power supply wire, the cross-sectional area of said connector being substantially less than the cross-sectional area of said passage b. inserting a detached rivet in said passage which is initially attached to said wall by means of a narrow bridge, c. bending a first part of said electrical conductor at an angle to the longitudinal axis of the passage thereby forming a resilient element for firm contact with said conductive connecting means and bending another part of said electrical conductor to at least partly adjoin the outside of said wall adjacent to said passage, and d. upsetting said rivet in said passage on either side of said wall whereby said conductor is urged against an adjacent relatively small part of the inner surface of the passage to form a firm connection between said conductor and the adjacent inner surface of said passage.

* * * * *